US006121628A

United States Patent [19]

Rising

[11] Patent Number: 6,121,628

[45] Date of Patent: Sep. 19, 2000

[54] METHOD, GAS TURBINE, AND COMBUSTOR APPARATUS FOR SENSING FUEL QUALITY

[75] Inventor: Bruce W. Rising, Oviedo, Fla.

[73] Assignee: Siemens Westinghouse Power Corporation, Orlando, Fla.

[21] Appl. No.: 09/282,135

[22] Filed: Mar. 31, 1999

[51] Int. Cl.[7] ..... G01N 15/06; F23N 5/24

[52] U.S. Cl. ..... 250/573; 73/1.02; 340/618; 340/619; 431/18

[58] Field of Search ..... 250/573, 577; 340/618, 619; 73/1.02; 356/379; 431/18, 308, 350

[56] References Cited

U.S. PATENT DOCUMENTS

| | | | |
|---|---|---|---|
| 4,043,742 | 8/1977 | Egan et al. | 431/12 |
| 4,816,695 | 3/1989 | Lavin | 250/573 |
| 5,218,212 | 6/1993 | Sato et al. | 250/573 |
| 5,239,860 | 8/1993 | Harris et al. | 73/61.48 |
| 5,262,645 | 11/1993 | Lambert et al. | 250/339 |
| 5,348,645 | 9/1994 | Maggard et al. | 208/209 |
| 5,349,188 | 9/1994 | Maggard | 250/339 |
| 5,349,189 | 9/1994 | Maggard | 250/339.07 |
| 5,361,586 | 11/1994 | McWhirter et al. | 60/737 |
| 5,517,427 | 5/1996 | Joyce | 364/510 |
| 5,537,336 | 7/1996 | Joyce | 364/510 |
| 5,637,881 | 6/1997 | Burghard et al. | 250/573 |
| 5,672,873 | 9/1997 | Yamazoe | 250/339.12 |
| 5,672,887 | 9/1997 | Shaw et al. | 250/573 |
| 5,708,272 | 1/1998 | Ranson et al. | 250/339.12 |
| 5,713,206 | 2/1998 | McWhirter et al. | 60/747 |
| 5,742,064 | 4/1998 | Infante | 250/458.1 |
| 5,791,145 | 8/1998 | Freen | 60/603 |
| 5,818,063 | 10/1998 | Wilhelmstatter et al. | 250/573 |

*Primary Examiner*—Scott J. Sugarman
*Attorney, Agent, or Firm*—Eckert Seamans Cherin & Mellott, LLC

[57] ABSTRACT

A gas turbine includes a compressor for compressing air and discharging compressed air. A combustor produces a hot gas by burning a fuel having a quality level in the compressed air. A turbine expands the hot gas produced by the combustor. A fuel delivery system delivers the fuel to the combustor. A fuel quality sensor senses the quality level of the fuel which is delivered to the combustor. A control and monitoring system stops delivery of the fuel as a function of the quality level, and stores a history of the quality level.

26 Claims, 3 Drawing Sheets

METHOD, GAS TURBINE, AND COMBUSTOR APPARATUS FOR SENSING FUEL QUALITY

BACKGROUND OF THE INVENTION

1. Field of the Invention

This invention relates to a gas turbine having a combustor for burning fuel and, more specifically, to a combustor, such as a gas turbine combustor, for burning fuel and sensing fuel quality. The invention also relates to a method and combustor for burning fuel and sensing fuel quality.

2. Background Information

In a gas turbine, fuel is burned with compressed air, produced by an attached compressor. The combustion reaction takes place in one or more combustors. An example of such a combustor is disclosed in U.S. Pat. No. 5,361,586, which is incorporated by reference herein. An example of such a gas turbine is disclosed in U.S. Pat. No. 5,713,206, which is incorporated by reference herein.

Substantial costs and problems may arise if a user employs a relatively low quality fuel, or an otherwise non-specified fuel, and attempts to burn this fuel in a combustor for a gas turbine. The use of low quality or non-specification fuels can cause damage to combustors and other hot section components of a gas turbine.

Typically, random, batch fuel testing is employed off-line to determine compliance with either a contract fuel or a fuel which meets the requisite combustor fuel specification. This testing procedure requires a technician, a suitable fuel tester, and one or more laboratory devices to measure fuel quality. However, problems may result due to the periodic nature of the fuel sampling. For example, during periods when no fuel is sampled, it is possible for an inappropriate fuel to be used and, thus, potentially cause damage to high value components in a gas turbine.

It is, therefore, desirable to provide a combustor, such as a gas turbine combustor, with a non-obtrusive, economical, real-time, on-line fuel sensing function.

SUMMARY OF THE INVENTION

This need and others are satisfied by the invention which is directed to a gas turbine or a combustor which senses the quality level of fuel which is delivered for burning, and either stops delivery of the fuel as a function of the quality level, or stores a history of the quality level.

As one aspect of the invention, a gas turbine comprises a compressor for compressing air and discharging compressed air; a combustor for producing a hot gas by burning a fuel having a quality level in the compressed air; a turbine for expanding the hot gas produced by the combustor; means for delivering the fuel to the combustor; means for sensing the quality level of the fuel which is delivered to the combustor; and means for: stopping delivery of the fuel as a function of the quality level, or storing a history of the quality level.

Preferably, the means for sensing the quality level includes a light source, a light detector, and means for delivering the fuel between the light source and the light detector in order to transmit light through the fuel. The light detector monitors absorption of the light which is transmitted through the fuel.

As a refinement, the light source and the light detector have a distance therebetween, the light which is transmitted through the fuel is absorbed in proportion to the quality level and the distance, and the light detector has an output with a signal level which is inversely related to the quality level.

The means for stopping delivery of the fuel or storing a history of the quality level may include means for stopping delivery of the fuel as a function of the quality level, and means for storing a history of the quality level.

As another preferred refinement, the means for storing a history of the quality level includes means for storing the quality level with respect to operating time of the gas turbine, and means for displaying the quality level.

As another aspect of the invention, a combustor for burning fuel from a fuel supply comprises means for burning the fuel; means for delivering the fuel from the fuel supply to the means for burning the fuel; means for sensing the quality level of the fuel which is delivered to the means for burning; and means for stopping delivery of the fuel as a function of the quality level, or storing a history of the quality level.

As a further aspect of the invention, a method of burning fuel in a combustor comprises employing a fuel having a quality level; delivering the fuel to the combustor; sensing the quality level of the fuel which is delivered; burning the fuel which is delivered; and either stopping delivery of the fuel as a function of the quality level, or storing a history of the quality level.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "combustor" shall expressly include, but not be limited to, any combustion system in which a fuel is introduced and burned, such as, for example, internal or external combustion systems which produce a flame, a combustion turbine, a gas turbine combustor, a jet engine combustor, intermittent combustion systems such as a reciprocating engine, a boiler, an internal combustion engine, or any other heat engine.

As employed herein, the term "combustion zone" shall expressly include, but not be limited to, the chamber in which combustion occurs, such as, for example, the cylinder of a reciprocating engine; the single annular chamber or individual chambers of a gas turbine combustor; the combustion zone of a ramjet duct; the chamber, with a single venturi outlet, of a rocket; the space in a boiler furnace in which combustion of gaseous products from the fuel takes place; the space in an internal combustion engine above the piston in which combustion occurs; or any open or closed flame, and shall further expressly include all components that come into contact with hot gas products resulting from combustion, such as, for example, a turbine which receives hot gas from a gas turbine combustor.

Figure 1:
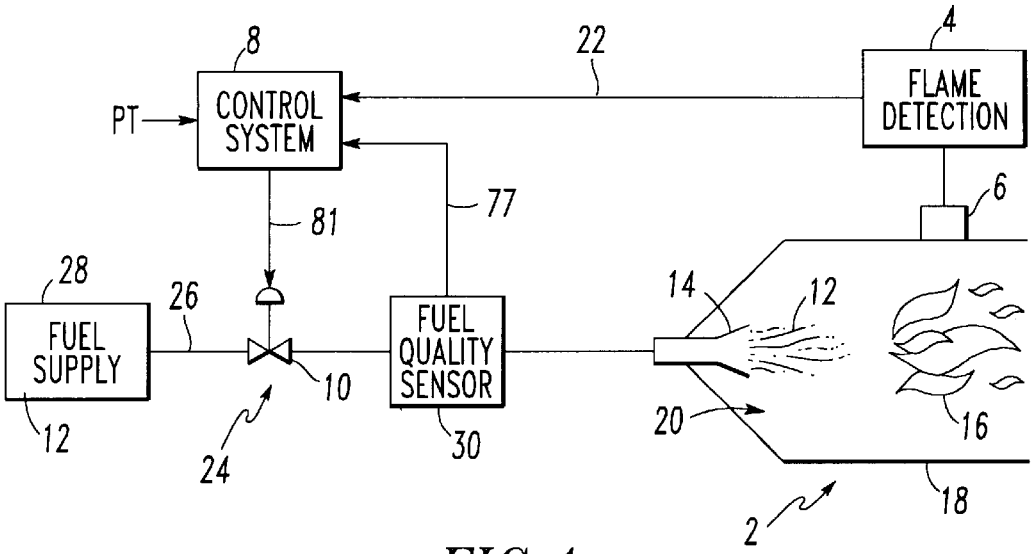
FIG. 1 is a block diagram of a combustor including a fuel quality sensor in accordance with one embodiment of the invention.

Referring to FIG. 1, a gas turbine combustor 2 includes an exemplary flame detection system 4 which comprises one or more optical flame detectors, such as detector 6, and a control system 8. For purpose of illustration, but not limitation, the invention is described herein in connection with exemplary gas turbine combustors, although the invention is applicable to a wide range of combustors with and without flame detection systems.

The exemplary control system 8 is connected to one or more fuel flow control valves, such as valve 10, in order to open, adjust, and/or close these valves to control the flow of fuel 12 to fuel nozzle 14. In turn, a combustion flame 16 is established in combustion chamber 18 by burning the fuel 12 in the presence of air 20. Upon the flame detection system 4 detecting loss of the combustion flame 16, signal 22 is output. In response to the signal 22, the control system 8 closes the valve 10. Once the valve 10 is closed, fuel 12 is no longer delivered to the combustion chamber 18 by fuel delivery system 24. That system 24 has a fuel line 26 which operatively connects a fuel supply 28 to the valve 10, to a fuel quality sensor 30, and to the combustor 2. Without the delivery of the fuel 12, combustion is arrested. In this manner, the exemplary control system 8 is integrated with the flame detection system 4, although separate systems may be employed.

The fuel quality sensor 30 senses a quality level of the fuel 12 which is delivered to the combustor 2. Preferably, the sensor 30 includes a light source (e.g., broadband white light, a wavelength specific light, infrared light, monochromatic laser light) and a light detector. The light detector monitors the absorption of light (e.g., reduction in amplitude) as light passes through the fuel 12. Light absorption may be approximated by Beer-Lambert calculations, whereby the light is absorbed in proportion to the fluid properties and the path length.

Fuel quality can be determined by the amount of light absorption, either in broadband or in specific wavelengths. Lower quality fuels are typically opaque to most wavelengths of light. High quality fuels, such as kerosenes and No. 2 fuel oils, are reasonably transparent in specific wavelength regions.

Figure 2:
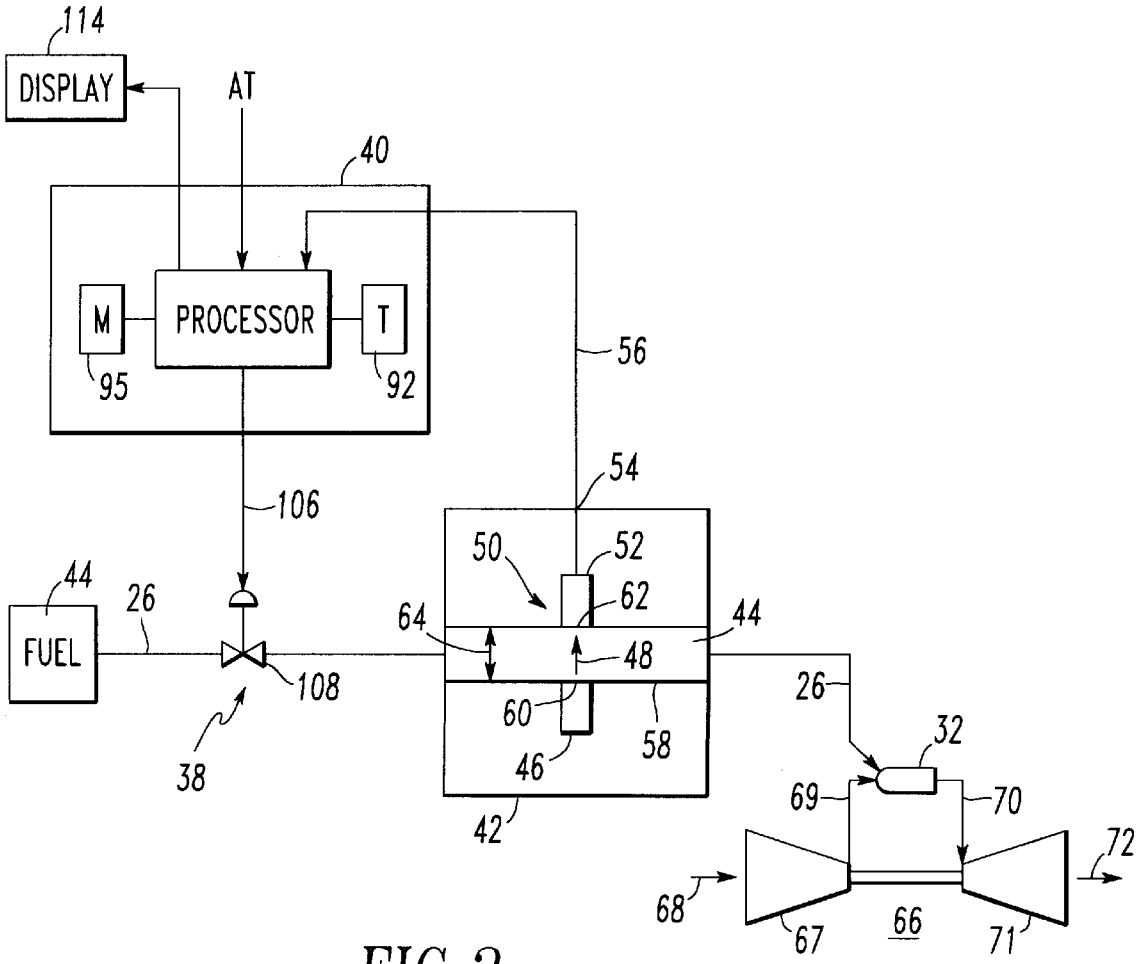
FIG. 2 is a block diagram of a gas turbine including a fuel quality sensor in accordance with another embodiment of the invention.

Referring to FIG. 2, an exemplary gas turbine combustor 32 for a gas turbine 66 is illustrated. The gas turbine 66 also includes a fuel delivery system 38, a control system 40, and a fuel quality sensor 42 for sensing the quality level of the fuel 44 which is delivered to the combustor 32.

The sensor 42 includes a light source, such as photo-emitter 46, for sourcing light 48; a mechanism 50 for passing the light 48 through the fuel 44; and a light detector, such as an optical detector or photo-detector 52, for detecting the light 48 which is transmitted through the fuel 44. In turn, the exemplary photo-detector 52 has an output 54 with a fuel quality level signal 56 which is representative of the quality level of the fuel 44. Non-limiting examples of the light source include an optical transmitter, such as a light emitting diode (LED) which emits a broadband white light, an LED or laser which emits a wavelength specific infrared light, or a laser which emits a monochromatic light for transmission through the fuel 44. Because some fuels are deliberately dyed using colored dyes, monochromatic laser light or wavelength specific light is preferably employed.

The mechanism 50 functions to deliver the fuel 44 through the conduit 58 thereof and, thus, between the photo-emitter 46 and the photo-detector 52 in order to transmit the light 48 through the fuel 44. The exemplary mechanism 50 also includes a first window (or lens) 60 for admitting the light 48 from the photo-emitter 46 to the fuel 44 in the conduit 58, and a second window (or lens) 62 for admitting the light 48 from the fuel 44 to the photo-detector 52.

The photo-emitter 46 and the photo-detector 52 have a distance 64 therebetween which is determined by the conduit 58 and windows 60,62. The light 48 which passes through the fuel 44 is absorbed in proportion to the quality level of the fuel 44 and the distance 64. The output signal 56 of the photo-detector 52 has a signal level which is inversely related to the fuel quality level. In this manner, the sensor 42 monitors absorption of the light 48 which passes through the fuel 44. The photo-emitter 46 and photo-detector 52 are employed in the fuel line 26 to continuously monitor the fuel quality level in real-time. The light 48 from the photo-emitter 46 passes through the fuel 44, with the photo-detector 52 normally observing a reduction in measured light for the fuel fluid stream.

As low quality fuels (e.g., No. 4 or No. 6 fuel oils) often have significantly different optical properties than high quality fuels (e.g., No. 1 or No. 2 fuel oils), information on fuel quality can be inferred from optical measurements. For high quality fuels, the absorption is typically less than about 25% and is wavelength specific. On the other hand, if a low quality fuel enters into the fuel fluid stream, then there is a significant decrease in transmissivity (i.e., increased light absorption) and a corresponding decrease in the photo-detector output signal level 56. Since the photo-detector output 54 responds with a reduced signal level, the continuous output 54 is employed in the logic of the control system 40 (e.g., as an alarm, trip signal, and/or historically recorded parameter) to protect and/or monitor the unit and to shutdown or trip the combustor 32, thereby protecting the gas turbine 66 from running with lower quality fuel. In turn, the control system 40 may also determine that the fuel 44 is of a specific grade and/or may monitor the fuel grade over the operating life of the gas turbine 66.

For example, if a user is suspected of having blended No. 4 oil (which is fairly opaque) with No. 2 oil, which is significantly clearer, then the on-line fuel sensor 42 may detect this type of fuel switch (or blend). Optical methods have the unique advantage that a signal output may be logged electronically and, also, may be incorporated into the safety features of the combustor 32 (e.g., by causing a shutdown). In turn, downtime, damage, and costs due to operation with inappropriate fuels are minimized.

The fuel sensor 42 cooperates with a suitable control system 40 to sense the fuel quality level. In turn, the control system 40 disables the fuel delivery system 38 as a function of the fuel quality level to, thereby, arrest combustion whenever quality levels are too low. As is conventional, the gas turbine 66 is comprised of a compressor 67 into which ambient air 68 is drawn. The compressor 67 discharges compressed air 69 to a combustor, such as the combustor 32, in which fuel, such as fuel 44, is burned to produce a hot gas 70. The hot gas 70 is expanded in the turbine 71 and then discharged as exhaust gas 72. In this manner, the exemplary control system 40 not only protects the combustor 32 but, also, all hot section components, such as the exemplary turbine 71, from damage resulting from use of low quality or non-specification fuels.

Although the exemplary control system 40 is preferably separate from a turbine control system (not shown), an integrated control system may be employed.

As discussed below in connection with FIGS. 3 and 4, the fuel sensors 30,42 cooperate with the respective control systems 8,40 to sense the fuel quality level. In turn, the control systems 8,40 disable the fuel delivery systems 24,38 and, thus, stop delivery of the fuel 12,44, respectively, as a function of the fuel quality level to, thereby, arrest combustion whenever the fuel quality is too low. Preferably, the control systems 8,40 also maintain an historical record of the fuel quality level.

Figure 3:
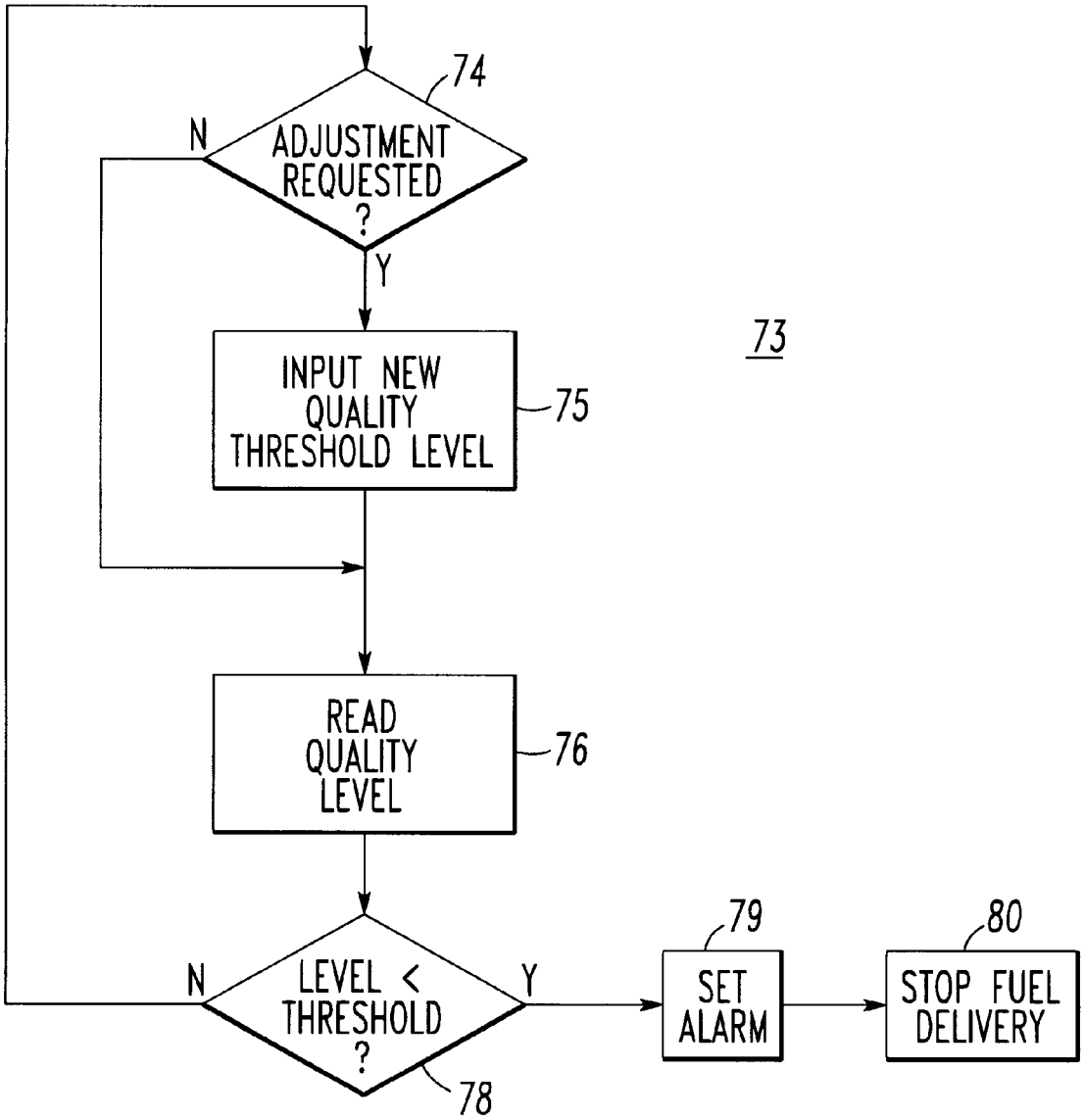
FIG. 3 is a flowchart of one embodiment of software suitable for execution by the control systems of FIGS. 1 and 2.

Referring to FIG. 3, an exemplary software routine 73 for execution by the control system 8 of FIG. 1 is illustrated. Although processor-based control systems 8,40 are shown, the invention is also applicable to a wide range of control devices (e.g., analog control systems, digital control systems, hybrid control systems). The routine 73 obtains a fuel quality level (e.g., output signal 77 of sensor 30 having a signal level which is inversely related to the fuel quality level) from the corresponding fuel sensor and, then, compares the level to a predetermined (e.g., PT of FIG. 1) or suitably adjusted fuel quality threshold level (e.g., minimum allowable quality level). The predetermined level PT is preferably preselected to approximate a quality level of a type of fuel (e.g., kerosene, No. 1 fuel oil, No. 2 fuel oil). Then, the result of the comparison is employed to determine whether to disable the corresponding fuel delivery system and, thus, arrest combustion.

First, at 74, it is determined whether an adjustment of the threshold level has been requested by the user. If so, at 75, the user suitably inputs a new threshold level. Otherwise, if no adjustment was requested, and after 75, the fuel quality level is read, at 76, from the output signal 77 of the fuel sensor 30. Then, at 78, the level is compared to the threshold level. If the level is less than the threshold level, then, at 79, an alarm is generated. Next, at 80, output signal 81 is set to close the valve 10 and, thereby, stop delivery of the fuel 12. Otherwise, after 78, execution resumes at 74.

By employing the exemplary fuel sensor 30 mounted in-line with the fuel line 26, all of the burning fuel 12 can be continuously screened, in real-time, for fuel quality. When an inappropriate fuel quality is detected, the alarm is generated. In turn, the alarm is employed to stop delivery of the fuel 12 as a function of the fuel quality level, and to shutdown the combustor 2, thereby reducing the risk of combustor damage.

Figure 4:
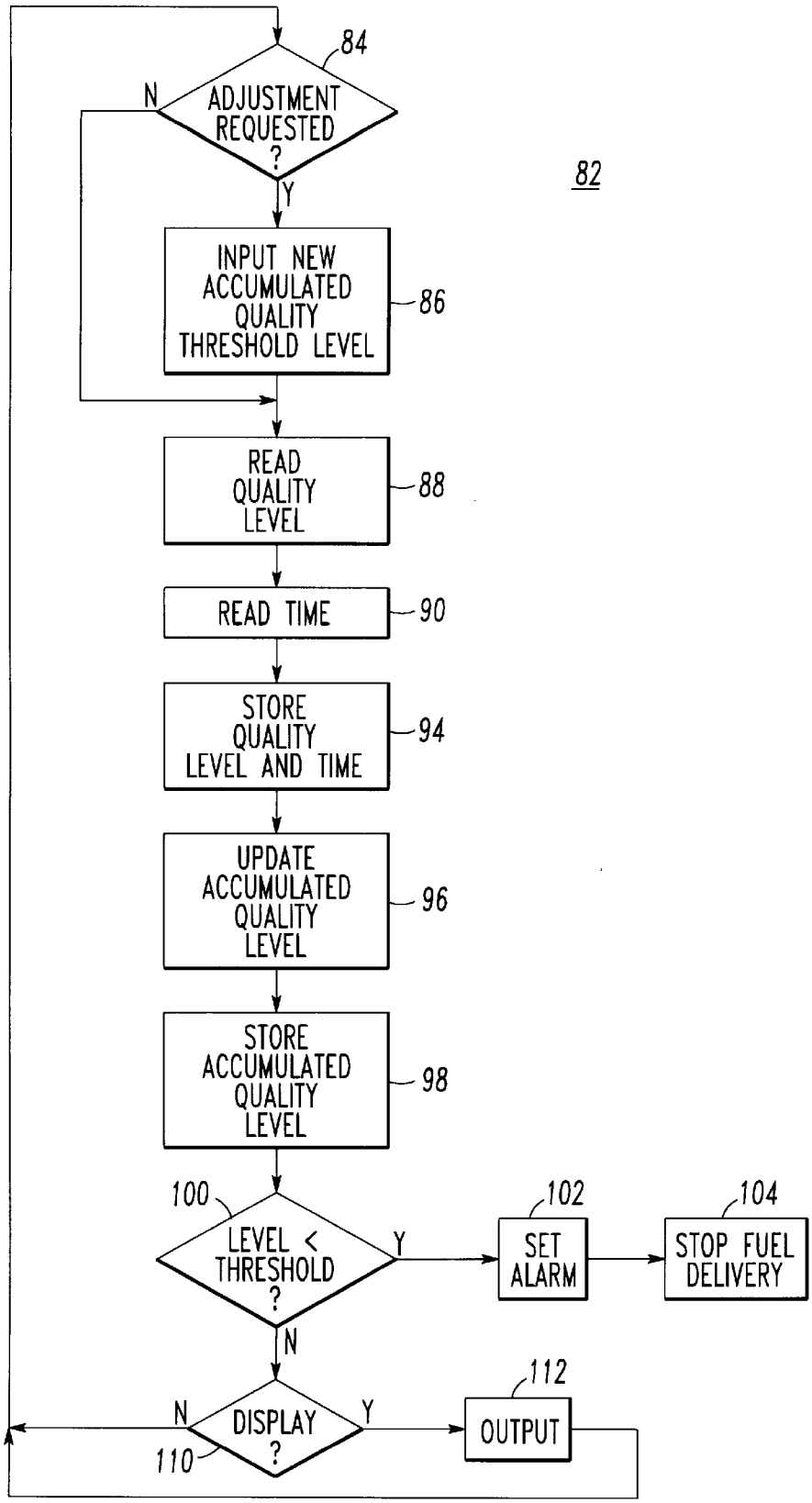
FIG. 4 is a flowchart of another embodiment of software suitable for execution by the control systems of FIGS. 1 and 2.

Referring to FIG. 4, an exemplary software routine 82 for execution by the control systems 8 and 40 of FIGS. 1 and 2, respectively, is illustrated. Although processor-based control systems 8,40 are shown, the invention is also applicable to a wide range of control devices (e.g., analog control systems, digital control systems, hybrid control systems). The routine 82 obtains a fuel quality level from the corresponding sensor and, then, compares the level to a predetermined or suitably adjusted threshold level (e.g., AT of FIG. 2). The adjusted level AT is preferably selected in view of the quality level of a type of fuel. Then, the result of the comparison is employed to determine whether to disable the corresponding fuel delivery system and, thus, arrest combustion.

For convenience of reference, the routine 82 of FIG. 4 is described with respect to the control system 40 of FIG. 2, although it is also applicable to the control system 8 of FIG. 1. Steps 84,86,88,100,102,104 of routine 82 generally correspond to the respective steps 74,75,76,78,79,80 of routine 73 of FIG. 3. First, at 84, it is determined whether an adjustment of the accumulated fuel quality threshold level has been requested by the user. If so, at 86, the user suitably inputs a new accumulated threshold (e.g., AT of FIG. 2) level. Otherwise, if no adjustment was requested, and after 86, the level 56 is read, at 88, from the fuel sensor 42. The time of that reading is obtained, at 90, from a timer (T) 92. Then, at 94, the level and time are stored in a suitable data storage such as exemplary memory (M) 95 (e.g., disk, RAM). Next, at 96, the accumulated level is updated (e.g., the level 56 is integrated and/or averaged, the level 56 is inverted and integrated) and then stored, at 98, in the memory 95. In this manner, an historical record of the quality level of the fuel 44 is stored with respect to operating time of the combustor 32 and turbine 71 of the gas turbine 66.

For example, the accumulated level may be calculated from the initial time of operation of the gas turbine 66, over any previous time period (e.g., one second, one minute, one hour, one day, one month, one year), or since a previous time (e.g., since 1:07 pm) and/or date. In this manner, an historical record of the accumulation of the level 56 is updated and stored with respect to operating time.

At 100, the accumulated fuel quality level is compared to the accumulated threshold level. If the accumulated level is less than the threshold level (although if the level 56 is inverted, at 96, then the test is the accumulated level being greater than the threshold level), then, at 102, an alarm is generated. Next, at 104, output signal 106 is set to close valve 108 and, thereby, stop delivery of the fuel 44. Otherwise, after 100, at 110, it is determined whether display of the accumulated level has been requested. If so, at 112, a suitable history of the accumulated level, levels and/or time is output to display 114. Otherwise, if no output was requested, and after 112, execution resumes at 84.

As shown in FIG. 2, the display 114 is employed by the control system 40 to display the historical record of the quality levels and/or accumulated level over the operating life of the gas turbine 66. Although an exemplary accumulated level is disclosed, other variables (e.g., operating temperature, power output, load) may also be monitored, stored, displayed, and considered as part of the alarm logic.

The exemplary fuel sensors of FIGS. 1 and 2 are employed to continuously sense the fuel quality level of the respective combustors 2 and 32 in real-time. These systems have a relatively long useful life, result in lower repair costs and less frequent repairs. Since the detection of fuel quality occurs during the delivery and burning of the fuel, all of the fuel must be delivered to the combustors and, thus, all of the fuel to be burned can, theoretically, be checked for fuel quality. By monitoring fuel quality, and shutting off the fuel delivery system when inappropriate fuel quality is detected, the risk of damage is significantly reduced. Furthermore, continuous, real-time sensing protection may be incorporated into control logic to protect the gas turbine, without relying on laboratory results. This process is less expensive than other processes which employ a laboratory fuel analyzer.

Although the invention has been discussed with reference to a combustor for a gas turbine, the invention may be practiced with respect to combustors used in other types of machinery in which the detection of fuel quality is desirable. For example, other combustors may employ different arrangements for fuel delivery, such as plural fuel flow control valves to start, adjust, and/or stop the flow of fuel to the combustor. Still other combustors may employ plural fuel lines, and, thus, plural fuel quality sensors may be employed.

The present fuel sensing system is in-line with the fuel that is pumped to the combustor and measures that fuel continuously. In this manner, the system may be incorporated into the control logic to protect the gas turbine on-line by identifying when a non-specified fuel is being used and shutting down the unit, without relying on laboratory results. Hence, protection and monitoring are real time and continuous, and not batch, periodic or aperiodic. This provides a more reliable measure of the actual fuel type being employed, while being less expensive than batch sampling methods of fuel analysis. Furthermore, the quality information can be stored electronically and serve as an historical record of fuel quality, type and use.

While for clarity of disclosure reference has been made herein to the exemplary display 114 for displaying historical fuel quality records, it will be appreciated that the historical information may be stored, printed on hard copy, be computer modified, or be combined with other data. All such processing shall be deemed to fall within the terms "display" or "displaying" as employed herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A gas turbine comprising:

a compressor for compressing air and discharging compressed air;

a combustor for producing a hot gas by burning a fuel having a quality level in said compressed air;

a turbine for expanding said hot gas produced by said combustor;

means for delivering the fuel to said combustor;

means for sensing the quality level of the fuel which is delivered to said combustor; and means for:

(a) stopping delivery of the fuel as a function of the quality level, or (b) storing a history of the quality level.

2. The gas turbine of claim 1 wherein said means for sensing the quality level includes means for sourcing a light, means for passing the light through the fuel, and means for detecting the light which passes through the fuel and outputting the quality level.

3. The gas turbine of claim 2 wherein said means for sourcing a light is a photo-emitter; and wherein said means for detecting the light is a photo-detector.

4. The gas turbine of claim 2 wherein said means for passing the light through the fuel includes a conduit for said fuel, a first window for admitting the light from said means for sourcing a light to said fuel, and a second window for admitting the light from said fuel to said means for detecting the light.

5. The gas turbine of claim 1 wherein said means for sensing the quality level includes a light source, a light detector, and means for delivering the fuel between said light source and said light detector in order to transmit light through the fuel.

6. The gas turbine of claim 5 wherein said light source is a light emitting diode which emits a broadband white light for transmission through the fuel.

7. The gas turbine of claim 5 wherein said light source is a light emitting diode which emits a wavelength specific light for transmission through the fuel.

8. The gas turbine of claim 5 wherein said light source is a laser which emits monochromatic light for transmission through the fuel.

9. The gas turbine of claim 5 wherein said light detector monitors absorption of said light which passes through the fuel.

10. The gas turbine of claim 9 wherein said light source and said light detector have a distance therebetween; wherein said light which passes through the fuel is absorbed in proportion to the quality level and said distance; and wherein said light detector has an output with a signal level which is inversely related to said quality level.

11. The gas turbine of claim 1 wherein said means for: (a) stopping delivery of the fuel includes means for comparing the quality level with a predetermined level which is preselected to approximate a quality level of a type of fuel.

12. The gas turbine of claim 1 wherein said means for: (a) stopping delivery of the fuel includes means for comparing the quality level with an adjustable level which is selected to approximate a quality level of a type of fuel.

13. The gas turbine of claim 1 wherein said means for sensing the quality level includes means for sensing the quality level in real-time.

14. The gas turbine of claim 1 wherein said means for sensing the quality level includes means for continuously sensing the quality level.

15. The gas turbine of claim 1 wherein the quality level is an accumulation of a fuel quality level over time.

16. The gas turbine of claim 1 wherein said means for: (b) storing a history of the quality level includes means for storing the quality level with respect to operating time of said gas turbine; and means for displaying said quality level.

17. A combustor for burning fuel from a fuel supply, the fuel having a quality level, said combustor comprising:

means for burning the fuel;

means for delivering the fuel from the fuel supply to said means for burning the fuel;

means for sensing the quality level of the fuel which is delivered to said means for burning; and means for:

(a) stopping delivery of the fuel as a function of the quality level, or (b) storing a history of the quality level.

18. The combustor of claim 17 wherein said combustor is a gas turbine combustor.

19. The combustor of claim 17 wherein said means for burning the fuel includes a combustion zone.

20. The combustor of claim 17 wherein said means for delivering the fuel includes a fuel line.

21. The combustor of claim 17 wherein said means for burning the fuel produces a combustion flame; and wherein said means for: (a) stopping delivery of the fuel is integrated with flame detection means for detecting said combustion flame.

22. The combustor of claim 17 wherein said means for: (a) stopping delivery of the fuel, or (b) storing a history of the quality level includes:

means for stopping delivery of the fuel as a function of the quality level, and means for storing a history of the quality level.

23. The combustor of claim 17 wherein said means for: (a) stopping delivery of the fuel, or (b) storing a history of the quality level includes only means for stopping delivery of the fuel as a function of the quality level.

24. The combustor of claim 17 wherein said means for: (a) stopping delivery of the fuel, or (b) storing a history of the quality level includes only means for storing a history of the quality level.

25. A method of burning fuel in a combustor, said method comprising:

employing a fuel having a quality level;

delivering the fuel to said combustor;

sensing the quality level of the fuel which is delivered;

burning the fuel which is delivered; and either:

(a) stopping delivery of the fuel as a function of the quality level, or (b) storing a history of the quality level.

26. The method of claim 25 further comprising:

storing an historical record of the quality level with respect to operating time of said combustor; and displaying said historical record.

* * * * *